US009472884B2

(12) United States Patent
Kutsuna et al.

(10) Patent No.: US 9,472,884 B2
(45) Date of Patent: Oct. 18, 2016

(54) CONNECTOR

(71) Applicant: Yazaki Corporation, Minato-ku, Tokyo (JP)

(72) Inventors: Yoji Kutsuna, Makinohara (JP); Shin Nemoto, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/648,116

(22) PCT Filed: Nov. 27, 2013

(86) PCT No.: PCT/JP2013/081947
§ 371 (c)(1),
(2) Date: May 28, 2015

(87) PCT Pub. No.: WO2014/084272
PCT Pub. Date: Jun. 5, 2014

(65) Prior Publication Data

US 2015/0340793 A1 Nov. 26, 2015

(30) Foreign Application Priority Data

Nov. 29, 2012 (JP) ..... 2012-261499

(51) Int. Cl.
*H01R 13/436* (2006.01)
*H01R 13/506* (2006.01)

(52) U.S. Cl.
CPC ..... *H01R 13/4362* (2013.01); *H01R 13/506* (2013.01)

(58) Field of Classification Search
USPC ..... 439/733.1, 752, 595, 596
See application file for complete search history.

(56) References Cited

U.S. PATENT DOCUMENTS 5,167,534 A 12/1992 Ohsumi
7,261,603 B2 * 8/2007 Takahashi ..... H01R 13/4361 439/595

(Continued)

FOREIGN PATENT DOCUMENTS

CN 101483296 A 7/2009
CN 102447185 A 5/2012

(Continued)

OTHER PUBLICATIONS

Jun. 2, 2015—(WO) International Preliminary Report on Patentability and Written Opinion of ISA—Intl App PCT/JP2013/081947.

(Continued)

*Primary Examiner* — Alexander Gilman
(74) *Attorney, Agent, or Firm* — Banner & Witcoff, Ltd.

(57) ABSTRACT

A connector (11) is provided with a connector housing (13) which is formed to be divided into a connector section (17) with a terminal accommodation chamber (23) formed therein, and a connector cover section (19), and in which the connector section (17) and the connector cover section (19) are integrated with each other by being slide-fitted to each other. A spacer (15) which is locked to the connector housing (13) at a temporary locking position and a final locking position penetrates the connector section (17) and the connector cover section (19), thereby restricting movements of the connector section (17) and the connector cover section (19) in a slide fitting release direction (E), whereby the connector housing (13) is integrally retained.

5 Claims, 9 Drawing Sheets

(56) References Cited

U.S. PATENT DOCUMENTS

| | | | | |
|---|---|---|---|---|
| 7,470,157 | B2 | 12/2008 | Hiramatsu | |
| 7,661,999 | B2 | 2/2010 | Horiuchi et al. | |
| 8,602,819 | B2 * | 12/2013 | Uchida | H01R 13/4223 439/596 |
| 8,979,599 | B2 * | 3/2015 | Hautbois | H01R 13/4362 439/752 |
| 9,083,114 | B2 * | 7/2015 | Muro | H01R 13/4362 |
| 9,124,018 | B2 * | 9/2015 | Suzuki | H01R 13/4223 |
| 9,153,894 | B2 * | 10/2015 | Gerwatowski | H01R 13/4223 |
| 2001/0039151 | A1 * | 11/2001 | Tsuji | H01R 13/4361 439/752 |
| 2002/0039863 | A1 * | 4/2002 | Morello | H01R 13/4361 439/752 |
| 2003/0148669 | A1 * | 8/2003 | Ishikawa | H01R 13/4362 439/752 |
| 2008/0009201 | A1 * | 1/2008 | Hiramatsu | H01R 13/4365 439/752 |
| 2009/0111318 | A1 * | 4/2009 | Horiuchi | H01R 13/4362 439/407 |
| 2009/0291599 | A1 * | 11/2009 | Fukamachi | H01R 13/4362 439/752 |

FOREIGN PATENT DOCUMENTS

| | | | |
|---|---|---|---|
| JP | H04-306573 | A | 10/1992 |
| JP | H05-347167 | A | 12/1993 |
| JP | 2008-016261 | A | 1/2008 |
| JP | 2009-110669 | A | 5/2009 |
| JP | 2009-110670 | A | 5/2009 |

OTHER PUBLICATIONS

Feb. 18, 2014—International Search Report—Intl App PCT/JP2013/081947.

Jun. 2, 2016—(CN) Notification of the First Office Action—App 201380062627.3.

Jul. 26, 2016—(JP) Notification of Reasons for Refusal—App 2012-261499.

* cited by examiner

CONNECTOR

TECHNICAL FIELD

The present invention relates to a connector.

BACKGROUND ART

In a connector, for a reason such as adding an additional function such as semi-fitting detection or enabling the forming of a complex internal shape while reducing a size, there is a case where a plurality of divided components are coupled together and used (refer to PTL 1).

A connector 501 shown in FIG. 9 is configured to be divided into two components, a housing 503 having a main functional portion of the connector 501 in which a terminal 513 is accommodated, and a front retainer 505 which is assembled to the housing 503 from the front, thereby enabling semi-fitting detection of the terminal 513. In the front retainer 505, a locking receiving portion 507 is formed. The locking receiving portion 507 is selectively locked to a temporary locking portion 509 formed in the housing 503, or a shared locking portion (a temporary locking portion and a final locking portion) 511 formed posterior to the temporary locking portion 509. The locking receiving portion 507 is fitted between the temporary locking portion 509 and the shared locking portion 511, whereby the front retainer 505 is retained at a temporary locking position with respect to the housing 503. The locking receiving portion 507 is locked to the shared locking portion 511 from the rear, whereby the front retainer 505 is retained at a final locking position with respect to the housing 503 with return to the temporary locking position side restricted.

CITATION LIST

Patent Literature

[PTL 1] Japanese Patent Publication No. JP-A-2008-16261

SUMMARY OF INVENTION

Technical Problem

However, in the structure of the above-described connector 501 configured to be divided into a plurality of components, it is necessary to perform the retaining in a coupled state of the front retainer 505 by the lock of the locking receiving portion 507 or the shared locking portion 511. In order to enhance a retaining force of the front retainer 505, it is necessary to increase an engaging margin of the locking receiving portion 507 or the shared locking portion 511 or increase the strength of the locking receiving portion 507 and the shared locking portion 511. That is, in a case where the retaining in a coupled state of a plurality of components is performed by the lock of a flexible structure such as a lock arm, in order to enhance a retaining force, it is necessary to increase an engaging margin of the lock or enhance the rigidity of the lock arm, and thus there is a problem that causes an increase in the size of a component or an increase in assembling operation force.

The present invention has been made in view of the above-described circumstances and an object thereof is to provide a connector in which a retaining force of a plurality of components can be enhanced without causing an increase in the size of a component or an increase in assembling operation force.

Solution to Problem

The above object related to the present invention is achieved by the following configurations.

(1) A connector including: a connector housing which is formed to be divided into a connector section with a terminal accommodation chamber accommodating a terminal formed therein, and a connector cover section that covers the connector section, and in which the connector section and the connector cover section are integrated with each other by being slide-fitted to each other in a terminal insertion direction, wherein a spacer which is incorporated into the connector housing and locked to the connector housing at a temporary locking position enabling insertion of the terminal into the terminal accommodation chamber and a final locking position preventing coming-out of the terminal penetrates the connector section and the connector cover section along a direction orthogonal to a slide fitting direction of the connector housing, thereby restricting movements of the connector section and the connector cover section in a slide fitting release direction, whereby the connector housing is integrally retained.

According to the connector having the configuration of the above (1), the spacer penetrates the connector section and the connector cover section along the direction orthogonal to the slide fitting direction of the connector section and the connector cover section, whereby a spacer front surface comes into contact with a coming-out prevention portion of the connector cover section. In this way, the movements of the connector section and the connector cover section in the slide fitting release direction are restricted through the spacer, and the connector housing is integrally retained. That is, the spacer penetrates the connector section and the connector cover section, like a bolt, whereby it is possible to integrally retain the connector housing, and therefore, a lock having a flexible structure, such as a lock arm, becomes unnecessary.

(2) The connector having the configuration of the above (1), wherein a lance which locks the terminal accommodated in the terminal accommodation chamber, thereby preventing coming-out of the terminal, is provided in the connector cover section.

According to the connector having the configuration of the above (2), the lance is provided in the connector cover section which is formed separately from the connector section in which the terminal accommodation chamber is formed, whereby a reduction in the size of the connector housing becomes easy. That is, it becomes possible to integrally mold the lance even in the terminal accommodation chamber which becomes smaller due to a reduction in the size of the connector housing.

The present invention has been briefly described above. In addition, the details of the present invention will be further clarified by reading through a form (hereinafter referred to as an "embodiment") for carrying out the invention which is described below, with reference to the accompanying drawings.

DESCRIPTION OF EMBODIMENTS

Hereinafter, an embodiment related to the present invention will be described with reference to the drawings.

Figure 1:
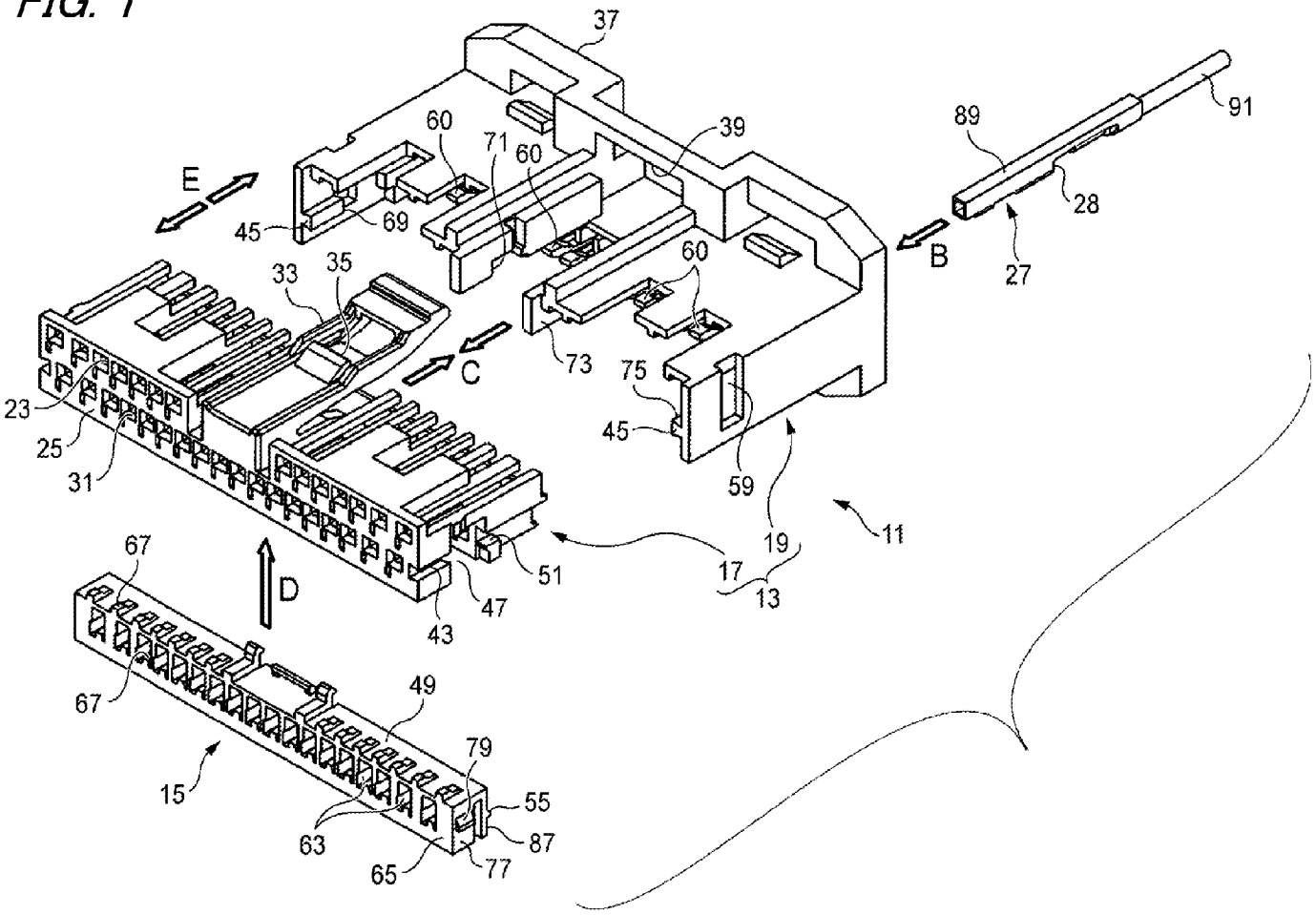
FIG. 1 is an exploded perspective view of a connector related to an embodiment of the present invention.
Figure 8A:
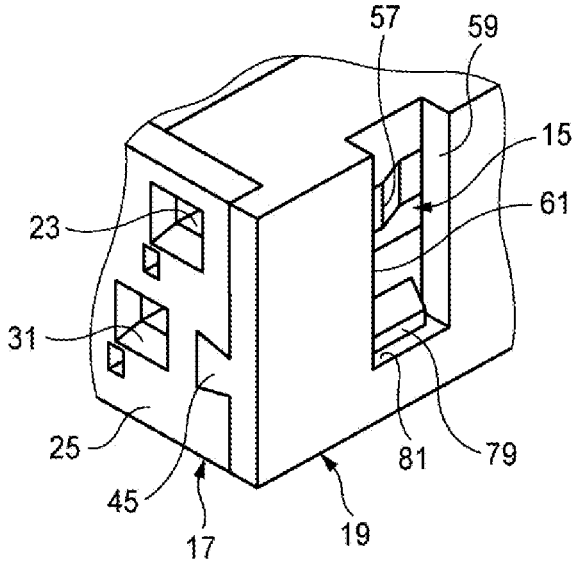
FIG. 8A is an enlarged perspective view of a main section of the connector housing in which the spacer is at the temporary locking position.

As shown in FIG. 1, a connector 11 related to an embodiment of the present invention is provided with a connector housing 13 and a spacer 15 made of synthetic resin. The connector housing 13 is formed to be divided into a connector section 17 made of synthetic resin and a connector cover section 19 likewise made of synthetic resin and covering the connector section 17, in order to enable the molding of a terminal accommodation chamber 23 having a complex internal shape provided with a lance 60, while reducing the size of a housing. The spacer 15 is mainly inserted into the connector section 17, thereby entering a mounting state. However, the spacer 15 has a structure in which at a temporary locking position (refer to FIG. 8A), the spacer 15 is also locked to the connector cover section 19, as will be described later.

The connector section 17 is formed in a rectangular parallelepiped shape which is long in a direction orthogonal to a coupling direction to a mating connector (not shown), and a plurality of terminal accommodation chambers 23 which are provided in parallel in a longitudinal direction are formed in plural stages (in this embodiment, two stages) in the vertical direction. The terminal accommodation chambers 23 are formed to penetrate a connector front surface 25 which becomes the coupling tip side to the mating connector, and a connector back surface 29 (refer to FIGS. 5A and 5B) which becomes the insertion side of a terminal 27. In the connector cover section 19, a plurality of lances 60, the locking tip side of each of which protrudes to each of the terminal accommodation chambers 23, are provided. The lance 60 locks a stepped portion 28 of the terminal 27, thereby preventing the backward coming-out of the terminal 27 from the terminal accommodation chamber 23. In the connector front surface 25, a male terminal pick-up surface 31 is formed corresponding to each of the terminal accommodation chambers 23. The male terminal pick-up surface 31 guides the acceptance of a male terminal of the mating connector.

At an approximate center of the upper surface of the connector section 17, a lock arm 33 in which a base end is connected to the connector section 17 and a tip becomes a free end toward the rear is integrally formed. At an approximately central portion of the lock arm 33, a lock claw 35 is provided to protrude upward, and the lock claw 35 locks the mating connector in a coupled state. The free end of the lock arm 33 is inserted into an insertion hole 39 bored in a rear flange portion 37 of the connector cover section 19, and thus an unlocking operation from the rear of the connector becomes possible.

Figure 2A:
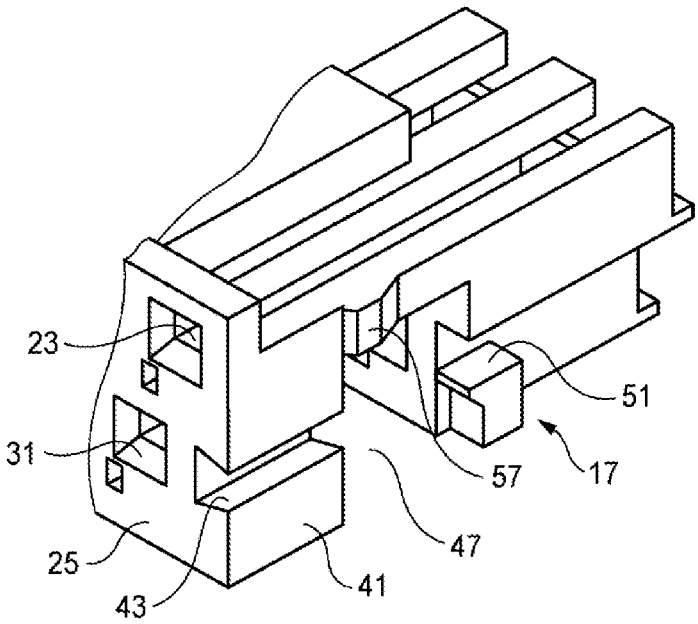
FIG. 2A is an enlarged view of a spacer receiving portion of a connector section shown in FIG. 1.

As shown in FIG. 2A, in a connector side surface 41, a dovetail-shaped guide groove 43 is formed along a front-back direction of the connector. Then, into the guide groove 43, a guide ridge 45 of the connector cover section 19 is inserted from the rear end side of the guide groove 43.

On the front portion side of the connector section 17, a spacer receiving portion 47 recessed over the longitudinal direction from the lower surface side is formed. The spacer receiving portion 47 is made to be able to receive the spacer 15 from the lower surface side of the connector section 17. The spacer receiving portion 47 opens a portion of the terminal accommodation chamber 23. The open portion of the terminal accommodation chamber 23 is covered with a spacer upper surface 49 by the spacer 15 being mounted in the spacer receiving portion 47.

On the connector side surface 41, a spacer final locking portion 51 is provided to protrude at the rear of the spacer receiving portion 47. The spacer final locking portion 51 locks a final locking projection 55 (refer to FIG. 2B) provided to protrude on a spacer back surface 53.

Figure 8B:
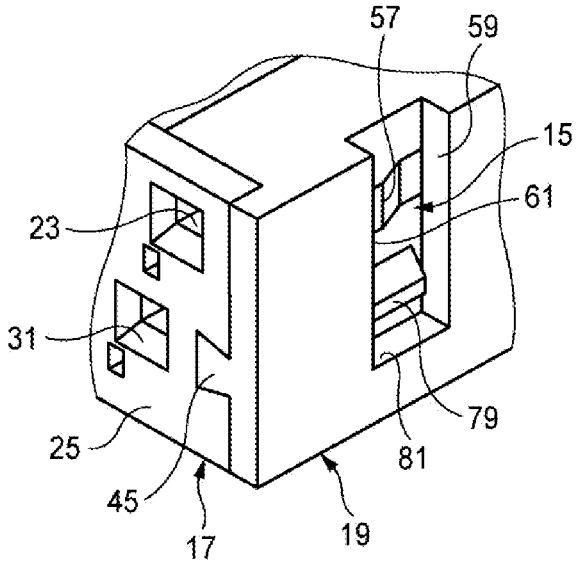
FIG. 8B is an enlarged perspective view of a main section of the connector housing in which the spacer is at the final locking position.
Figure 9:
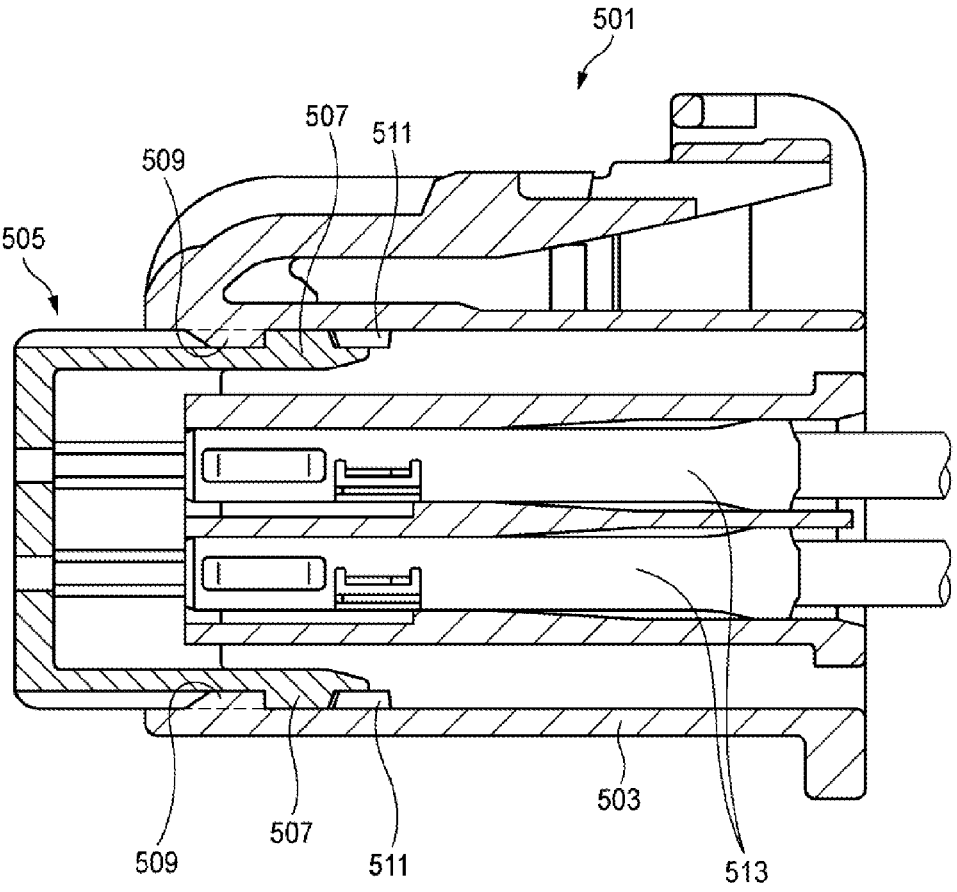
FIG. 9 is a cross-sectional view of a connector of the related art.

On the connector side surface 41, a cover locking projection 57 is provided to protrude above the spacer receiving portion 47. The cover locking projection 57 is temporarily locked to a window forward edge 61 (refer to FIGS. 8A and 8B) of a locking window 59 of the connector cover section 19. The connector section 17 is integrated with the connector cover section 19 by being slide-fitted to each other in a slide fitting direction C along a terminal insertion direction B, whereby the connector housing 13 is configured.

The spacer 15 is formed in a rectangular parallelepiped shape capable of being fitted to the spacer receiving portion 47 of the connector section 17. The spacer upper surface 49 of the spacer 15 blocks the open portion of the terminal accommodation chamber 23 of the upper stage. In the spacer 15, a plurality of terminal penetration holes 63 with which the terminal accommodation chambers 23 of the lower stage communicate are bored. The terminal penetration hole 63 penetrates the spacer back surface 53 and a spacer front surface 65. On the bottom side of the terminal penetration hole 63 and the spacer upper surface 49, double locking projections 67 which further lock the terminal 27 locked in the terminal accommodation chamber 23 by the lance 60, thereby double-locking the terminal 27, are provided to protrude corresponding to each of the terminal accommodation chambers 23 (refer to FIGS. 7A and 7B). The double locking projection 67 is disposed at a retracted position where it does not protrude to the terminal accommodation chamber 23 and does not interfere with the terminal 27, at a temporary locking position (described later) of the spacer 15.

In the spacer 15, the spacer front surface 65 comes into contact with a first coming-out prevention portion 69, a second coming-out prevention portion 71, a third coming-out prevention portion 73, and a fourth coming-out prevention portion 75 of the connector cover section 19. That is, the spacer front surface 65 comes into contact with the first coming-out prevention portion 69, the second coming-out prevention portion 71, the third coming-out prevention portion 73, and the fourth coming-out prevention portion 75, whereby the spacer 15 inserted into the spacer receiving portion 47 serves so as to prevent the forward coming-out of the connector section 17 from the connector cover section 19. In addition, the second coming-out prevention portion 71 and the third coming-out prevention portion 73 are formed as plate-shaped dedicated sites, whereas the first coming-out prevention portion 69 and the fourth coming-out prevention portion 75 are formed as rear end faces of the guide ridges 45.

Figure 2B:
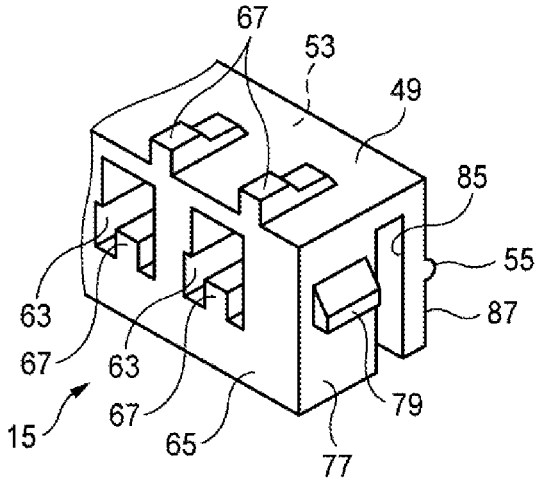
FIG. 2B is an enlarged view of a spacer side surface shown in FIG. 1.

As shown in FIG. 2B, on a spacer side surface 77, a temporary locking projection 79 is provided to protrude. The temporary locking projection 79 is locked to a window bottom edge 81 (refer to FIG. 8A) of the locking window 59 in the connector cover section 19 at the temporary locking position of the spacer 15. On both end sides in the longitudinal direction of the spacer back surface 53, the final locking projections 55 are provided to protrude. If the spacer 15 is moved to a final locking position (refer to FIG. 8B), the final locking projections 55 are locked to the spacer final locking portions 51 of the connector section 17 described above. The final locking projection 55 is provided in a flexible arm portion 87 which is formed due to a slit 85 formed in the spacer side surface 77, and thus is made to be elastically displaceable.

Figure 3:
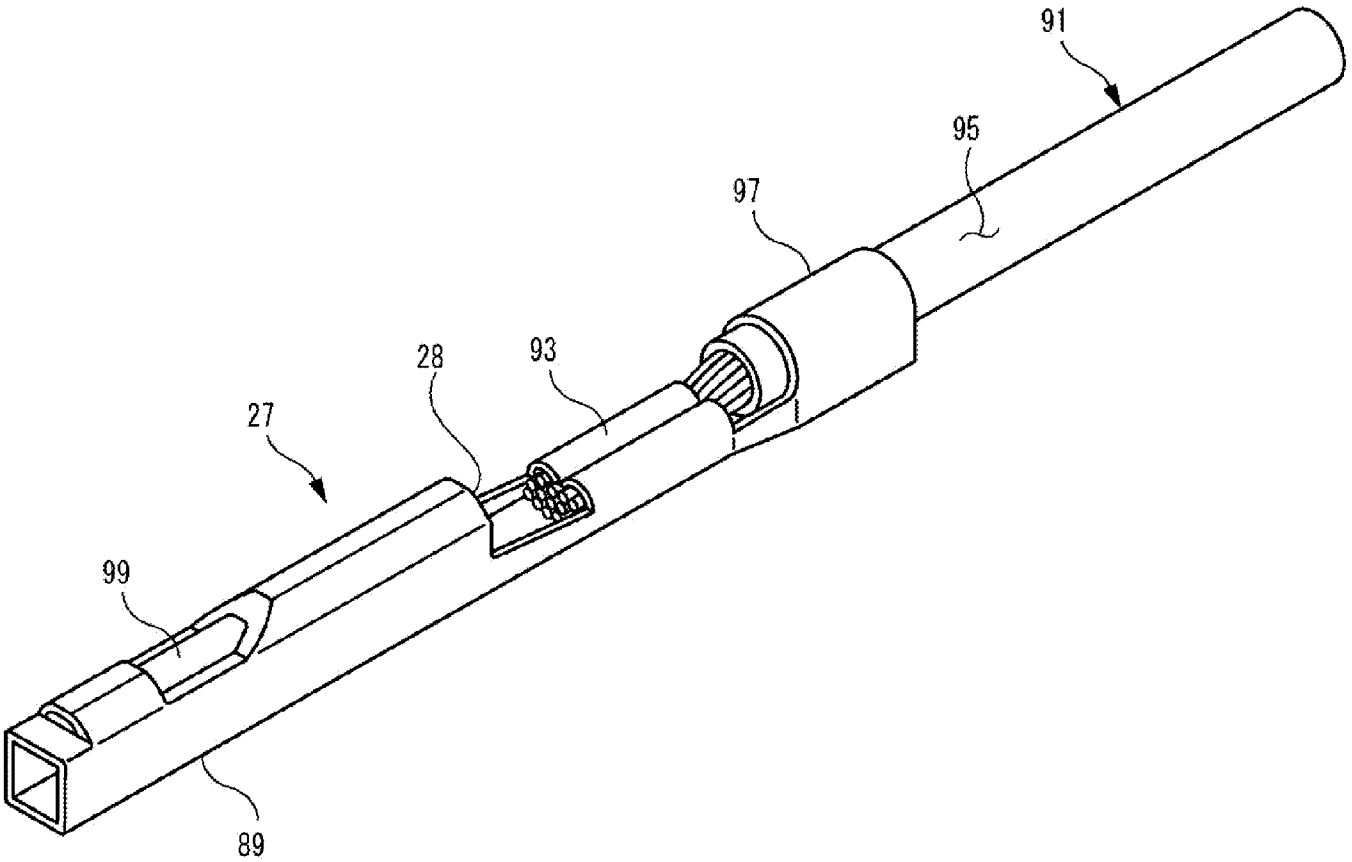
FIG. 3 is a perspective view of a terminal connected to an electric wire.

As shown in FIG. 3, the terminal 27 has a box-shaped electrical contact portion 89 with an elastic contact piece internally provided on the front portion side, and at the rear thereof, a conductor crimping portion 93 for connecting conductors of an electric wire 91, and an electric wire fixing portion 97 for fastening and fixing the electric wire 91 from the outer periphery of an exterior covering 95 are continuously provided in sequence. In the electrical contact portion 89, a double locking hole 99 into which the double locking projection 67 provided in the spacer 15 is fitted is bored.

The spacer 15 is incorporated into the connector housing 13 and selectively locked to the connector housing 13 at the temporary locking position enabling the insertion of the terminal 27 into the terminal accommodation chamber 23, and the final locking position preventing the coming-out of the terminal 27. In the connector 11, the spacer 15 restricts the movements of the connector section 17 and the connector cover section 19 in a slide fitting release direction E by penetrating the connector section 17 and the connector cover section 19 along a direction D orthogonal to the slide fitting direction C of the connector section 17 and the connector cover section 19. In this way, in the connector 11, the connector housing 13 is integrally retained.

Next, the assembling procedure and the operation of the connector 11 having the above-described configuration will be described.

Figure 4:
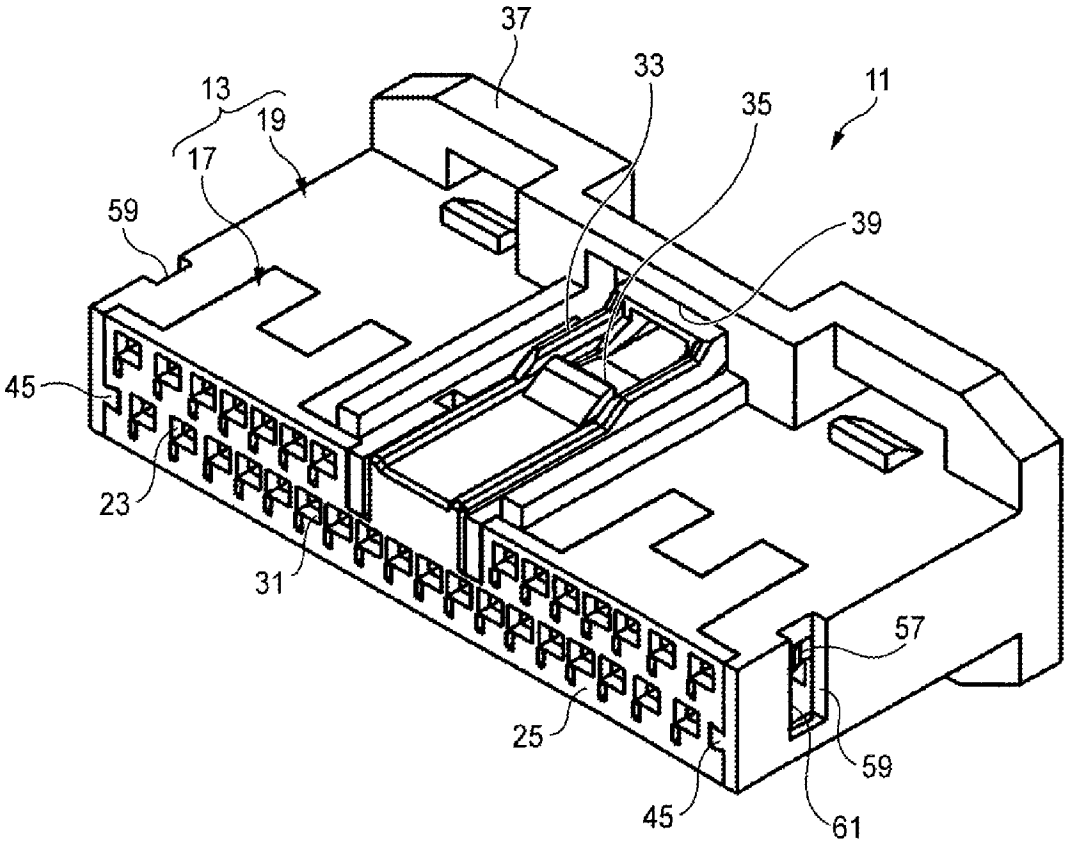
FIG. 4 is a perspective view of a connector housing in which the connector section shown in FIG. 1 and a connector cover section are coupled together and a spacer is not mounted.

As the assembling procedure of the connector 11, first, as shown in FIG. 4, the connector section 17 is inserted into the connector cover section 19 from the front. In this state, since the cover locking projection 57 is simply temporarily locked to the window forward edge 61 of the connector cover section 19, if the connector section 17 receives a force to extrude forward the connector section 17 with an operation such as terminal insertion, the connector section 17 easily comes out. Similarly, if the connector cover section 19 receives a force to extract backward the connector cover section 19 from the connector section 17, the connector cover section 19 easily comes out.

Figure 5A:
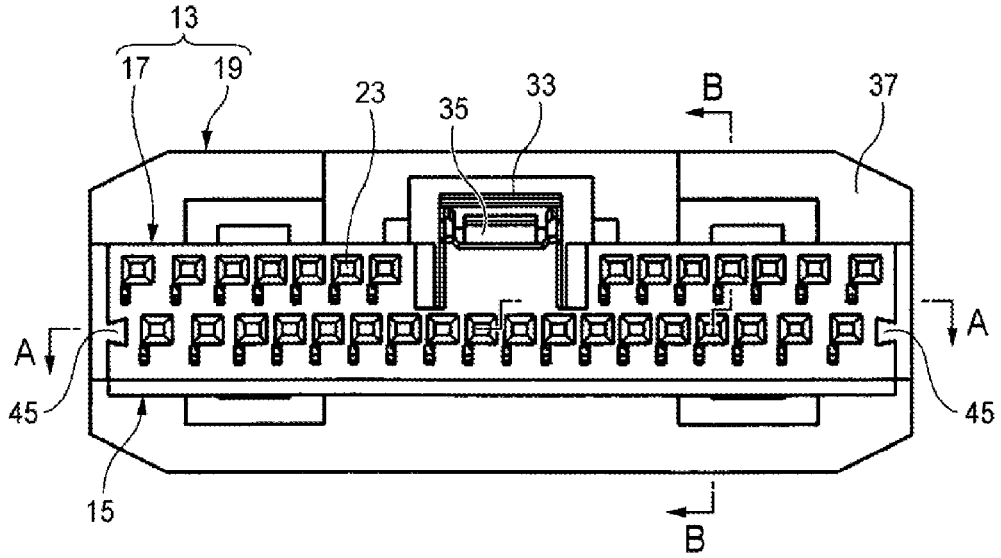
FIG. 5A is a front view of the connector housing in which the spacer is at a temporary locking position.
Figure 5B:
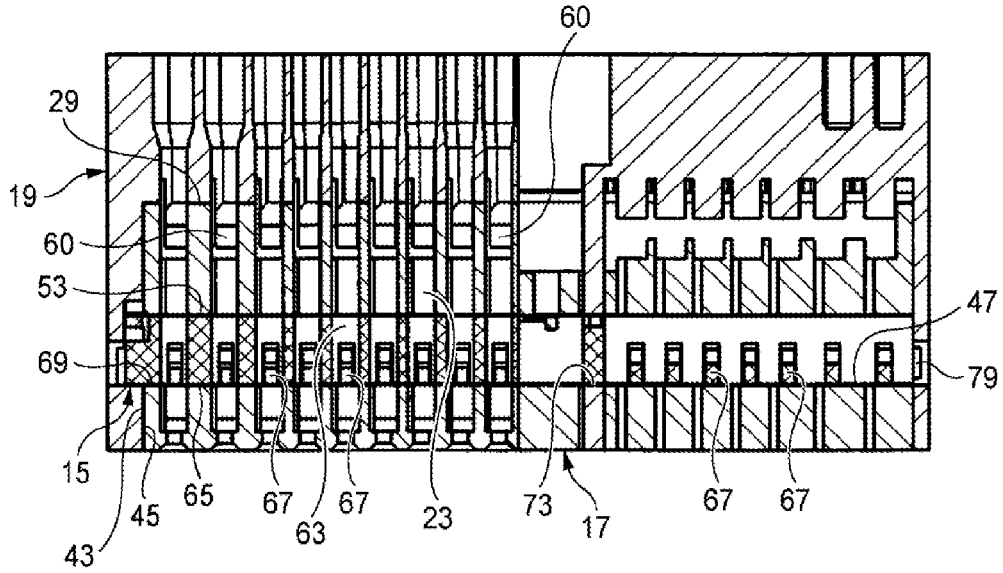
FIG. 5B is a cross-sectional view taken along line A-A of FIG. 5A.
Figure 7A:
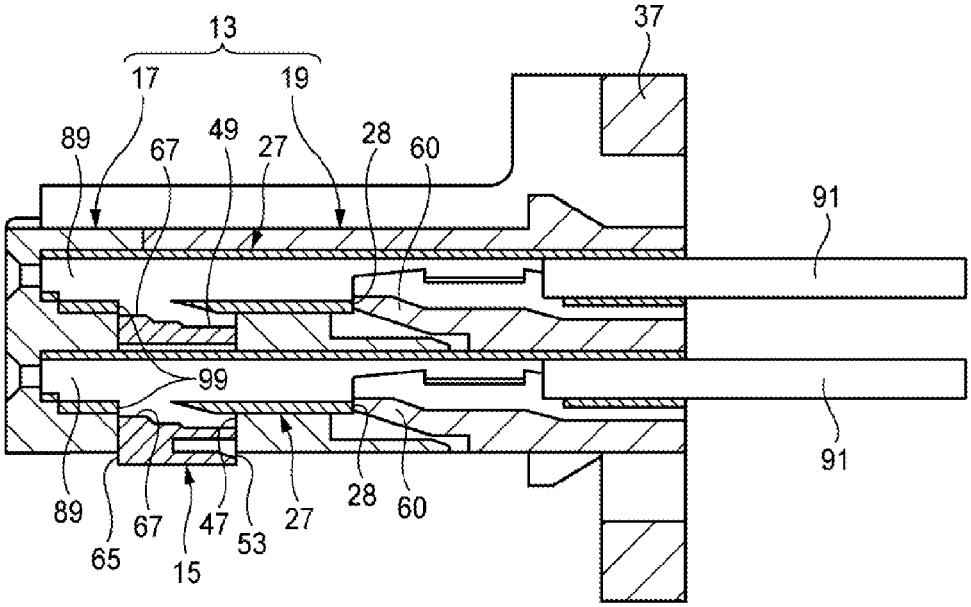
FIG. 7A is a cross-sectional view taken along line B-B of FIG. 5A.
Figure 7B:
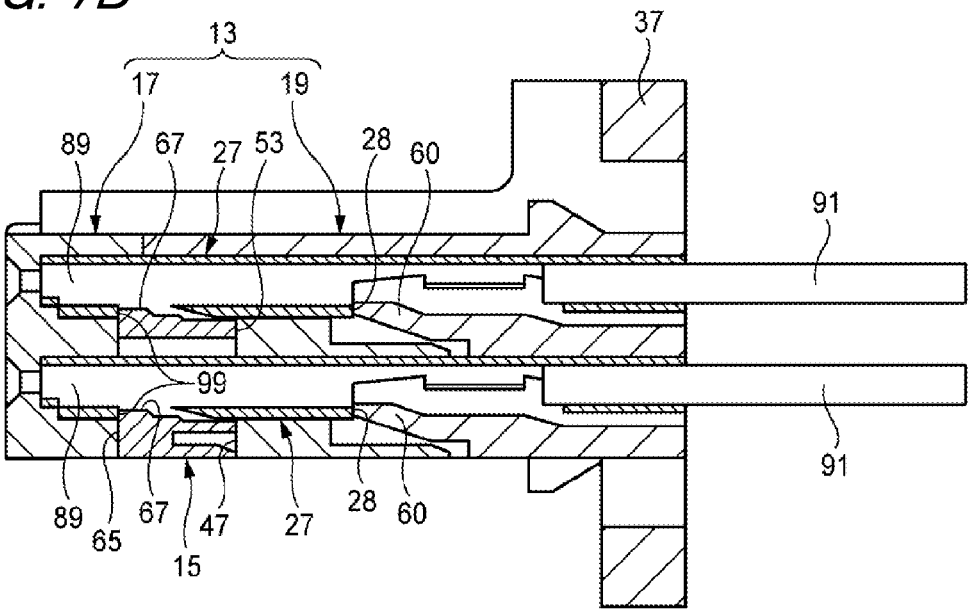
FIG. 7B is a cross-sectional view in which the spacer shown in FIG. 7A has been moved to a final locking position.

Next, as shown in FIGS. 5A, 5B, and 7A, in a state where the connector section 17 is inserted into the connector cover section 19 from the front, the spacer 15 is inserted from below the connecter section 17 and locked at the temporary locking position. In this temporary locking state, the spacer 15 enters the spacer receiving portion 47 of the connector section 17 and at the same time, the spacer front surface 65 comes into contact with the first coming-out prevention portion 69, the second coming-out prevention portion 71, the third coming-out prevention portion 73, and the fourth coming-out prevention portion 75 of the connector cover section 19. If the connector section 17 integrated with the spacer 15 due to the spacer 15 being mounted in the spacer receiving portion 47 is attempted to be moved in the slide fitting release direction E with respect to the connector cover section 19, the spacer front surface 65 comes into contact with the first coming-out prevention portion 69, the second coming-out prevention portion 71 (refer to FIG. 1), the third coming-out prevention portion 73, and the fourth coming-out prevention portion 75 (refer to FIG. 1), and thus the movement is prevented. That is, the connector section 17 is locked to the connector cover section 19 by the spacer 15 which acts like a bolt (a crossbar), and thus, even if the connector section 17 receives a force to extrude it forward with an operation such as terminal insertion, the connector section 17 does not come out. Similarly, even if the connector cover section 19 receives a force to extract backward the connector cover section 19 from the connector section 17, the connector cover section 19 does not come out. In this manner, in the connector 11, in the temporary locking state, the coming-out of the connector cover section 19 and the connector section 17 is prevented reliably and with high strength through the spacer 15.

Figure 6:
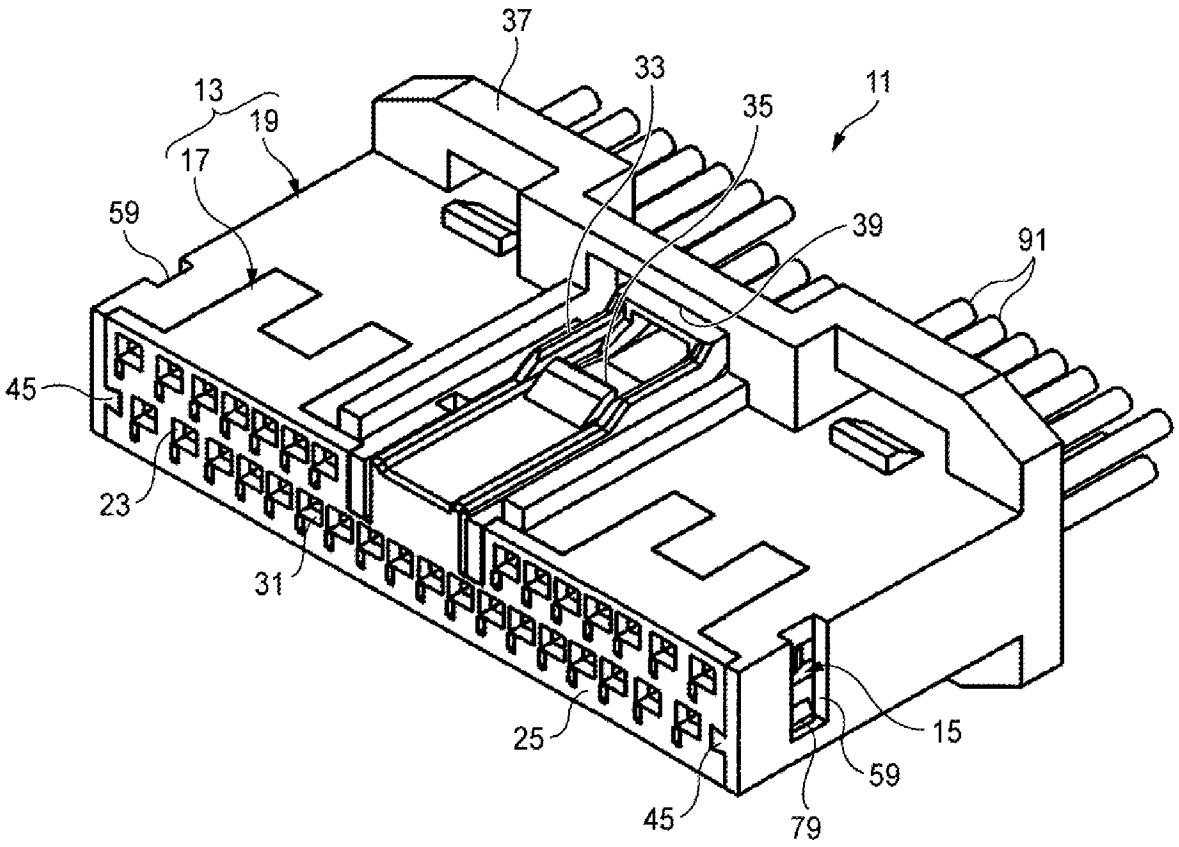
FIG. 6 is a perspective view of the connector housing on which the terminal is mounted at the temporary locking position of the spacer.

As shown in FIG. 6, in the state of the temporary locking position of the spacer 15, the terminal 27 (refer to FIG. 1) is inserted into an assembly of the connector section 17, the connector cover section 19, and the spacer 15 from the rear, and the stepped portion 28 is locked to the lance 60. After all the terminals 27 are mounted, the spacer 15 is further pushed in from below of the connector section 17, thereby being locked so as to be at the final locking position shown in FIGS. 7B and 8B. Also in this final locking state, similar to the temporary locking state described above, the spacer front surface 65 is in contact with the first coming-out prevention portion 69, the second coming-out prevention portion 71, the third coming-out prevention portion 73, and the fourth coming-out prevention portion 75, and thus the coming-out of the connector cover section 19 and the connector section 17 is prevented reliably and with high strength through the spacer 15. In this manner, the spacer 15 is locked at the final locking position, and thus the assembling of the connector 11 is completed.

In the connector 11 of this embodiment, the spacer 15 penetrates the connector section 17 and the connector cover section 19 along the direction D orthogonal to the slide fitting direction C of the connector section 17 and the connector cover section 19, whereby the spacer front surface 65 comes into contact with the first coming-out prevention portion 69, the second coming-out prevention portion 71, the third coming-out prevention portion 73, and the fourth coming-out prevention portion 75 of the connector cover section 19. In this way, the movements of the connector section 17 and the connector cover section 19 in the slide fitting release direction E are restricted through the spacer 15, and thus the connector housing 13 is integrally retained.

That is, the spacer 15 penetrates the connector section 17 and the connector cover section 19, like a bolt, whereby it is possible to integrally retain the connector housing 13.

For this reason, the prevention of coming-out of the connector section 17 and the connector cover section 19 which are housing components divided into two can be easily and solidly performed by the spacer 15. Further, since a lock having a flexible structure, such as a lock arm, need not be provided for the prevention of coming-out of the connector section 17 and the connector cover section 19 divided into two, a reduction in the size and simplification of the shape of the connector housing 13 are realized.

That is, in the connector 11 of this embodiment, the connector section 17 and the connector cover section 19 configuring the connector housing 13 are coupled together after having been separately formed, whereby it becomes possible to integrally mold the lance 60 even in the terminal accommodation chamber 23 which becomes smaller due to a reduction in the size of the connector housing 13, and thus a reduction in size becomes easy.

Therefore, according to the connector 11 related to this embodiment, a retaining force of the connector section 17 and the connector cover section 19 divided into two can be enhanced without causing an increase in the size of a component or an increase in assembling operation force, and a reduction in the size of the connector becomes easy.

Here, the features of the embodiment of the connector according to the present invention described above are briefly summarized and listed in the following [1] and [2].

[1] The connector 11 including: the connector housing 13 which is formed to be divided into the connector section 17 with the terminal accommodation chamber 23 accommodating the terminal 27 formed therein, and the connector cover section 19 that covers the connector section 17, and in which the connector section 17 and the connector cover section 19 are integrated with each other by being slide-fitted to each other in the terminal insertion direction B, wherein the spacer 15 which is incorporated into the connector housing 13 and locked to the connector housing 13 at the temporary locking position enabling the insertion of the terminal 27 into the terminal accommodation chamber 23 and the final locking position preventing the coming-out of the terminal 27 penetrates the connector section 17 and the connector cover section 19 along the direction D orthogonal to the slide fitting direction C of the connector housing 13, thereby restricting the movements of the connector section 17 and the connector cover section 19 in the slide fitting release direction E, whereby the connector housing 13 is integrally retained.

[2] The connector 11 having the configuration of the above [1], wherein a lance 60 which locks the terminal 27 accommodated in the terminal accommodation chamber 23, thereby preventing coming-out of the terminal 27, is provided in the connector cover section 19.

In addition, the present invention is not limited to the embodiment described above, and a modification, an improvement, or the like can be appropriately made. In addition, the material, the shape, the dimension, the number, the disposition place, or the like of each constituent element in the embodiment described above is arbitrary as long as it can achieve the present invention, and is not limited.

Further, this application is based on the Japanese patent application (Patent Application No. 2012-261499) filed on Nov. 29, 2012, the contents of which are incorporated herein by reference.

INDUSTRIAL APPLICABILITY

According to the connector related to the present invention, a retaining force of a plurality of components can be enhanced without causing an increase in the size of a component or an increase in assembling operation force.

REFERENCE SIGNS LIST

11: connector
13: connector housing
15: spacer
17: connector section
19: connector cover section
23: terminal accommodation chamber
27: terminal
60: lance
B: terminal insertion direction
C: slide fitting direction
D: direction orthogonal to slide fitting direction
E: slide fitting release direction

The invention claimed is:

1. A connector comprising:

a connector housing including:

a connector section with a terminal accommodation chamber accommodating a terminal formed therein, and a connector cover section separable from the connector section and configured to cover the connector section when attached thereto, wherein the connector section and the connector cover section are attachable with each other by being slide-fitted to each other in a terminal insertion direction; and a spacer, wherein the spacer is attachable and lockable to the connector housing at a temporary locking position enabling insertion of the terminal into the terminal accommodation chamber and a final locking position preventing withdrawal of the terminal, wherein the spacer is configured to penetrate the connector section and the connector cover section along a direction orthogonal to a slide fitting direction of the connector housing, thereby restricting movements of the connector section and the connector cover section in a slide fitting release direction, whereby the connector housing is integrally retained, wherein, when the spacer is in the temporary locking position, a first locking element of the spacer restricts the spacer from being withdrawn from the connector housing, wherein, when the spacer is disposed in the temporary locking position, the first locking element of the spacer is engaged with and in a locking position relative to the connector housing, thereby restricting the spacer from being separated from the connector housing, and wherein, when the spacer is disposed in the final locking position, a second locking element of the spacer is engaged with and in a locking position relative to the connector housing, thereby further restricting the spacer from being separated from the connector housing.

2. The connector according to claim 1, wherein the connector cover section includes a lance configured to lock the terminal accommodated in the terminal accommodation chamber, thereby preventing withdrawal of the terminal.

3. The connector according to claim 1, wherein the first lock element of the spacer is configured to engage with the connector covering section, and wherein the second lock element of the spacer is configured to engage with the connector section.

4. The connector according to claim 1, wherein the first lock element comprises a projection extending in a first direction orthogonal to the terminal insertion direction, and wherein the second lock element comprises a projection extending in a second direction parallel to the terminal insertion direction.

5. The connector according to claim 1, wherein the spacer is inserted farther into the connector housing when at the final locking position than when at the temporary locking position.

* * * * *